US006938733B2

(12) United States Patent
Eilinger

(10) Patent No.: US 6,938,733 B2
(45) Date of Patent: Sep. 6, 2005

(54) EMERGENCY POWER SUPPLY DEVICE FOR LIFT SYSTEMS

(75) Inventor: Thomas Eilinger, Morristown, NJ (US)

(73) Assignee: Inventio AG, Hergiswil (CH)

( * ) Notice: Subject to any disclaimer, the term of this patent is extended or adjusted under 35 U.S.C. 154(b) by 316 days.

(21) Appl. No.: 10/239,946

(22) PCT Filed: Mar. 21, 2001

(86) PCT No.: PCT/CH01/00175

§ 371 (c)(1),
(2), (4) Date: Sep. 24, 2002

(87) PCT Pub. No.: WO01/74703

PCT Pub. Date: Oct. 11, 2001

(65) Prior Publication Data

US 2003/0089556 A1 May 15, 2003

(30) Foreign Application Priority Data

Mar. 31, 2000 (EP) ..... 00810272

(51) Int. Cl.[7] ..... B66B 1/06
(52) U.S. Cl. ..... 187/290; 187/296
(58) Field of Search ..... 187/290, 296, 187/293, 297, 391, 393; 307/66, 69; 318/375, 376, 377, 106, 108, 109, 382, 161, 139; 320/118

(56) References Cited

U.S. PATENT DOCUMENTS 5,058,710 A * 10/1991 Iwasa ..... 187/290
5,260,637 A * 11/1993 Pizzi ..... 320/103
5,285,029 A * 2/1994 Araki ..... 187/290
5,656,915 A * 8/1997 Eaves ..... 320/118
5,712,456 A * 1/1998 McCarthy et al. ..... 187/290
5,796,175 A * 8/1998 Itoh et al. ..... 307/10.1
5,896,948 A * 4/1999 Suur-Askola et al. ..... 187/290
6,075,331 A * 6/2000 Ando et al. ..... 318/376
6,742,630 B2 * 6/2004 Eilinger ..... 187/290
2001/0019227 A1 * 9/2001 Girard ..... 307/66
2002/0096412 A1 * 7/2002 Batisse ..... 191/22 R
2002/0109406 A1 * 8/2002 Aberle et al. ..... 307/10.1

FOREIGN PATENT DOCUMENTS

JP 05051182 A * 3/1993 ..... B66B/5/02
JP 05070047 A * 3/1993 ..... B66B/1/32
JP 05078052 A * 3/1993 ..... B66B/5/02
JP 05221590 A * 8/1993 ..... B66B/5/02
JP 06016356 A * 1/1994 ..... B66B/5/00

OTHER PUBLICATIONS

Vinzenz (Supercapacitors for Elevators), 1998, Institute of Electronics. CH–6048.*
Rufer et al (A Supercapacitor–Based Energy–Storage System For Elevators With Soft Commutated Interface), 2002, IEE , vol. 38, No. 5. (Paper presented 2001 Industry Applications Society Annual Meeting.*

* cited by examiner

*Primary Examiner*—Jonathan Salata
(74) *Attorney, Agent, or Firm*—Schweitzer Cornman Gross & Bondell LLP

(57) ABSTRACT

Emergency current supply equipment for lift installations with electric motor drives has the task of bridging over temporary drops or interruptions in main voltage and of supplying, in the event of failure of the mains supply during a lift travel, all components of the lift installation needed for an evacuation travel with energy until such time as the lift car has reached the level of a story. The energy storage unit used for that purpose comprises as the storage medium exclusively capacitors in the form of super capacitors or a combination of super capacitors and electrochemically acting batteries.

7 Claims, 2 Drawing Sheets

EMERGENCY POWER SUPPLY DEVICE FOR LIFT SYSTEMS

Figure 1:
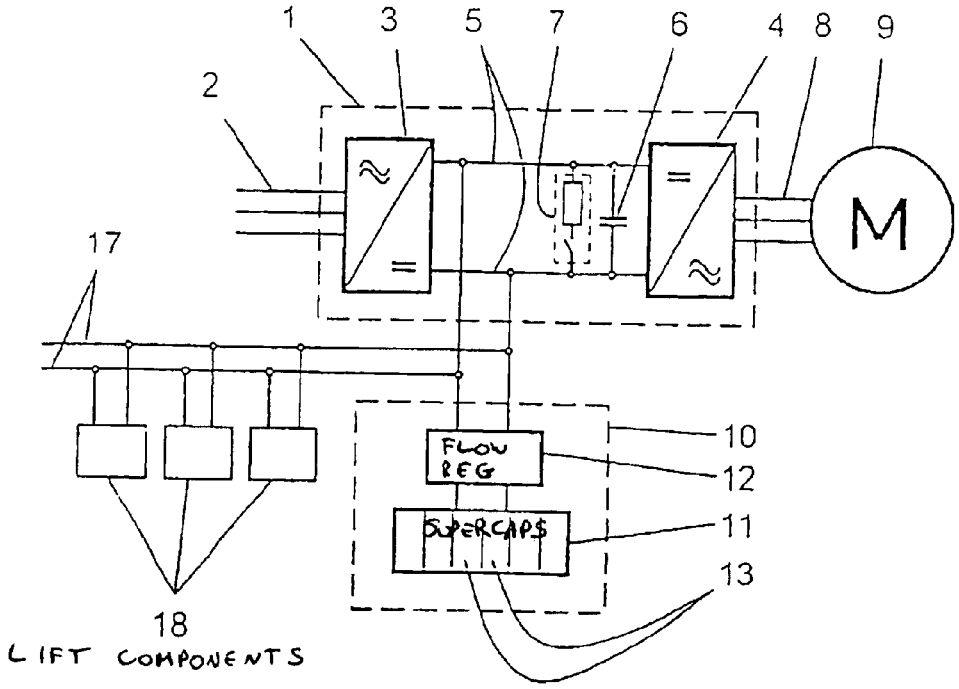

The present invention relates to emergency current supply equipment for lift installations with electric motor drives, which comprise an energy storage unit for electric energy, which bridges over temporary drops or interruptions in mains voltage and in the event of failure of the mains supply during a lift travel ensures performance of an evacuation travel in that it supplies all electrical components of the lift installation participating in the evacuation travel with energy until such time as the lift cage has reached the level of a storey.

Lifts for persons and goods are usually driven by electric motors. In that case various principles of transmission of lifting force to the travel car come into use. In one of the most popular embodiments a rotation motor acts directly, or by way of a translation gear, on a drive pulley driving the support cables, which in turn support and move on the one hand the lift car and on the other hand a counterweight. In another embodiment a rotation motor drives a hydraulic pump, which in essence actuates, by way of a pressure fluid the piston rod or rods of one or more hydraulic cylinders driving the lift car directly or by way of cable drives. According to a further drive principle the lift car or its counterweight connected therewith by support cables is moved back and forth by means of a linear motor. In modern lift installations, regulation of the lift car speed is usually carried out by way of a regulated change in the frequency of the three-phase current fed to the drive three-phase asynchronous motor.

It is generally common to all these drives that the drive energy is derived from a mains current supply, in which temporary drops or interruptions in mains voltage as well as longer-term mains failures occasionally occur. In the case of lift installations without emergency current supply equipment, unpleasant consequences for passengers can result from such events. The lift car remains in such situations between two storey stopping positions, which has the consequence that the passengers can no longer leave this lift car without outside help.

In order to avoid such a situation, a part of the lift installations is furnished with emergency current supply equipments. These comprise an energy storage unit, by means of the stored energy of which the drive is in a position to convey the lift car at least to the next storey and to keep the systems relevant to the lift in operation for that length of time.

There is known from U.S. Pat. No. 5,058,710 such an emergency current supply equipment which in the event of failure of the mains supply or temporary drops or interruptions in the mains voltage during a lift travel supplies the drive motor as well as the other electrical components of the lift installation important for an evacuation travel with stored electrical energy until the lift car has reached the next storey. Serving as energy storage unit is a battery which is charged by a charging device during normal operation and the poles of which are, in the event of failure of the mains supply, connected by way of the contacts of a mains monitoring relay with the direct voltage intermediate circuit of a frequency converter supplying the drive motor.

Emergency current supply equipment with electrochemically acting batteries (secondary elements) as sole energy stores have some significant disadvantages. In applications where a lift drive in the situation of failure of the mains supply must convey a fully-laden lift car to at least the next storey in travel direction with the assistance of an energy store and without travel interruption or speed reduction the energy store has to produce a large discharge power for a relatively short time. Electrochemical batteries have a relatively small power density (about 300 W/kg) and for the described use in a high-performance lift have to be so large in size that their mass reaches several hundred kilograms. In lifts where a battery frequently has to produce such outputs, the service life thereof is drastically reduced. Since in the case of batteries the permissible charging power is substantially smaller than the output power, the further problem results that when the mains supply is again available a longer charging time has to be waited out before the lift can go back into operation. Otherwise the risk would exist that the lift car in the event of a fresh mains failure would remain between two storeys. It is also disadvantageous with the use of batteries in lift installations that these have to be regularly monitored and serviced and after attaining their service life leave behind toxic wastes.

The present invention has the object of creating equipment for the emergency current supply of lift installations of the afore-described kind which avoids the stated disadvantages. In particular, this is to be reliably in the position, in the case of relatively frequently occurring failures of the mains voltage and temporary drops or interruptions in voltage supply, of making available for drive and control the high electrical power required for an uninterrupted onward travel of the lift car at normal speed at least to the next storey.

After use of the emergency current supply equipment this is to be operationally ready again within a few seconds after restoration of the mains supply. The service life thereof shall be a multiple of the service life of electrochemically acting batteries for the same load characteristics.

According to the invention the object is met by the features indicated in the independent patent claims 1 and 6. According to claim 1, equipment for the emergency current supply of lift installations with electric motor drives comprises an energy storage unit for electric energy and is characterised in that this energy storage unit comprises capacitors in the form of supercapacitors. According to claim 6 a method for emergency current supply of lift installations with electric motor drives is characterised in that at least a part of the emergency current supply energy is stored in storage media in the form of supercapacitors.

The invention is based on the concept of using new kinds of capacitors, so-called supercapacitors, instead of or in combination with batteries as the energy store, wherein usually an arrangement of several supercapacitors in series connection is used, which has a total capacitance of several Farads at voltages of up to several hundred volts. Supercapacitors are double-layer capacitors, the electrodes of which are coated with activated carbon and thereby have effective surface areas of several thousand square meters per gram of carbon, wherein the two electrodes are separated by the smallest spacings in the nanometre range. From these characteristics there results the extremely high capacitance of these energy stores available in commerce.

The use of supercapacitors as the energy storage medium for emergency current supply equipment of lift installations bring several advantages:

High permissible discharging power for a high number of charging and discharging cycles (power density of supercapacitors at the present time about 10 to 15 kW/kg; power density of batteries at the present time about 300 to 1000 W/kg). Uninterrupted switching-over from mains operation to emergency current operation as well as onward travel to the next storey at full drive power can thus be realised with an energy storage unit at least ten times lighter.

Very high charging power; thereby reduction in the required waiting time between restoration of the mains supply and operational readiness of the lift to a fraction of the time needed with batteries.

Service life many times higher than batteries.

No maintenance required of the energy storage unit.

No content of toxic or environmentally unfriendly substances.

Advantageous refinements and developments of the invention are evident from the subclaims.

For uses in which the equipment according to the invention serves on the one hand for bridging over relatively short-term drops or interruptions in mains voltage and where on the other hand in the case of an evacuation travel only the customary storey spacing has to be overcome, there is used, with advantage, an energy storage unit which contains exclusively supercapacitors as the storey medium. For uses in which, however, the possibility exists that the equipment according to the invention in the case of failure of the mains supply has to deliver energy for a full-load evacuation travel over large lifting heights it is advantageous to use an energy storage unit which consists of a combination of supercapacitors and electrochemically acting batteries (secondary elements), since the latter by comparison with supercapacitors have a higher energy density (Wh/kg), i.e. a higher storage capacity for the same weight. The mentioned conditions of use arise, for example, in lift installations where so-called lobby lifts operate with no stopping points over a plurality of storey distances, or in the case of lifts in viewing towers which travel to only one or two stopping points at great height.

The equipment according to the invention can be used particularly advantageously in combination with drives regulated by frequency converting. The frequency converter thereof essentially consists of a mains current rectifier, a direct voltage intermediate circuit with a smoothing capacitor and an alternating current rectifier with a control generator, wherein this alternating current rectifier supplies the drive motor with varying frequency and thus determines the rotational speed thereof. In embodiments in which the mains current rectifier is not provided for recuperation of the braking energy, the direct voltage intermediate circuit is usually equipped with a braking module. The equipment according to the invention, which comprises an energy storage unit consisting of supercapacitors or of a combination of such with batteries, receives energy from the aforesaid direct voltage intermediate circuit and delivers this as needed, i.e. in the event of drops or interruptions in mains voltage as well as for evacuation travels in the event of failure of the mains supply, back to the aforesaid direct voltage intermediate circuit. A regulating and control unit denoted as a power flow regulator in that case takes care of a required matching of the direct voltage levels between the energy storage unit and the intermediate circuit and regulates the energy exchange between this energy storage unit and the intermediate circuit of the frequency converter.

A particular advantage of the combination of the equipment according to the invention with a frequency converter as drive regulator results from the fact that the controller of the lift installation can be supplied with current from the direct voltage intermediate circuit of the frequency converter during normal operation as well as in emergency current operation. A completely uninterrupted supply of the lift controller during transition from normal operation to emergency current operation is thereby guaranteed and in addition the usual mains unit for the controller can be dispensed with.

In advantageous and cost-saving manner a single item of equipment according to the invention is used as emergency current supply equipment for the entire group of lifts in the case of lift installations which comprise a plurality of lifts, wherein each drive motor is supplied by a associated alternating current rectifier from a common direct voltage intermediate circuit.

Since on the one hand in a multiple installation all lift drives are never in operation simultaneously and loaded with positive full load and on the other hand the drive motors of conventional lifts with counterweight are, in the case of journeys with less than half the payload, even in the position of recuperating braking energy into the common direct voltage intermediate circuit, the required capacitance of the energy storage unit can be reduced to a fraction of the sum of all capacitances which would be required for all lifts of the group in the case of individual emergency current supply equipments.

In lift installations in which one or more lift vehicles run with an integrated drive system, it is advantageous to install the frequency converter, the lift control unit and the emergency current supply equipment according to the invention in mobile manner on the vehicle or vehicles. The energy storage unit of the vehicle is then charged in each case by way of contact elements or by means of contactless energy transfer systems. This methods has the advantage that energy feed equipments are not needed along the entire travel path, which is of interest particularly in the case of lift installations in which several lift shafts are present and the lift vehicles run in alternate lift shafts, wherein also horizontal journeys take place.

In a preferred use of the invention the energy storage unit and the power flow regulator are so designed that the emergency current supply unit according to the invention not only serves for carrying out an evacuation travel in the case of failure on the mains supply and bridging over drops and interruptions in mains voltage, but produces in normal operation a reduction in the mains power required for the installation. This takes place in that the energy storage unit during the standstill times of the lift as well as in phases of lower drive loading receives energy and feeds this back into the drive current circuit at peak load and in phases of above-average loading, wherein the energy flow in both directions is regulated by the power flow regulator. Where, for example, the emergency current supply equipment according to the invention co-operates with the frequency converter by which the drive motor is supplied with power in variable frequency manner, the energy supply unit thereof is charged from the direct voltage intermediate circuit of this frequency converter in phases of below-average motor loading, and this energy storage unit feeds back a part of the stored energy into this direct voltage intermediate circuit in phases of above-average loading.

The invention is further explained in the following by reference to the accompanying drawings.

Figure 2:
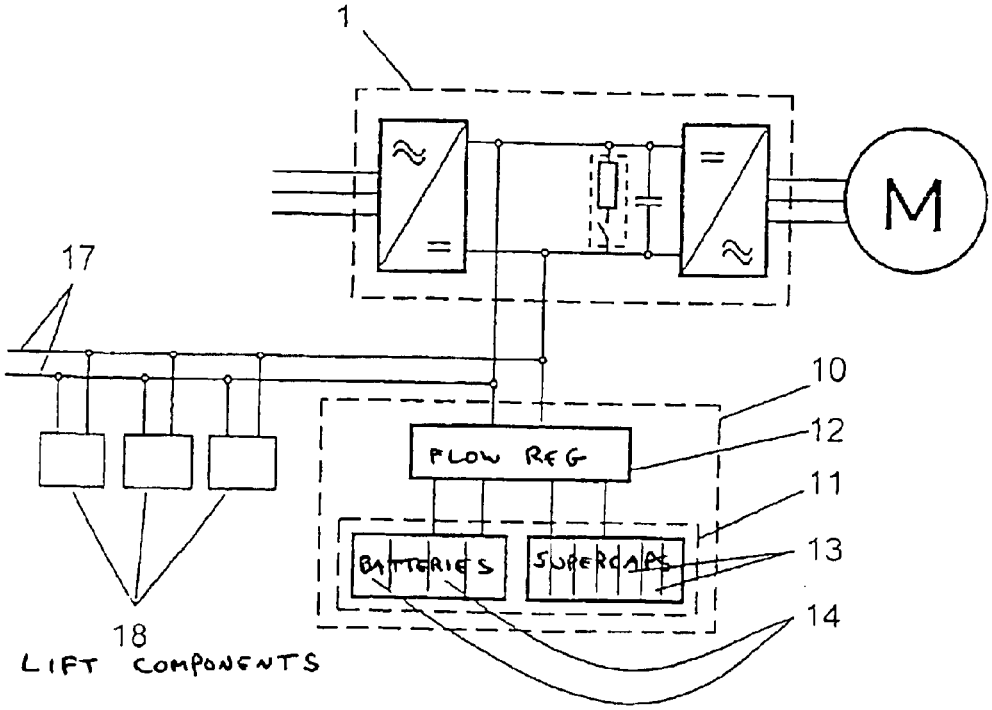
Figure 3:
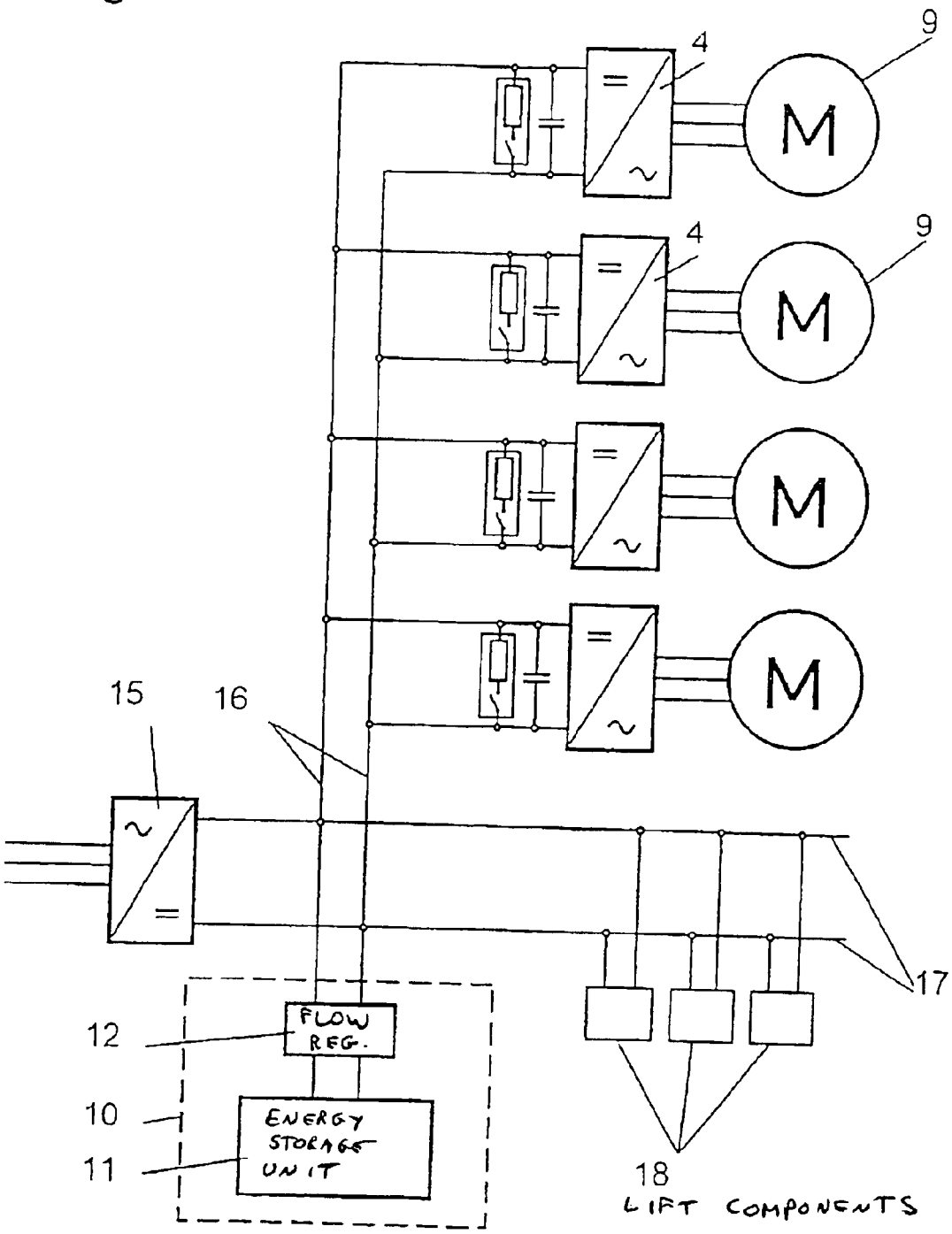

FIG. 1 shows a schematic illustration of the components of a lift drive, in which an emergency current supply equipment according to the invention co-operates with a frequency converter and comprises exclusively supercapacitors as the energy storage medium;

FIG. 2 shows a schematic illustration of the components of a lift drive, in which an emergency current supply equipment according to the invention similarly co-operates with a frequency converter and comprises a combination of supercapacitors and batteries as the energy storage medium; and FIG. 3 shows a schematic illustration of the components of a group of lift drives, in which an emergency current supply equipment according to the invention co-operates with a common direct voltage intermediate circuit of several frequency converters.

The essential components of a lift drive with a frequency converter and an emergency current supply equipment according to the invention are schematically illustrated in FIG. 1. Denoted by 1 is the frequency converter, which is supplied from the mains connection 2 and principally consists of a mains current rectifier 3, an alternating current rectifier 4, a direct voltage intermediate circuit 5, a smoothing capacitor 6, a brake module 7 (with brake resistance and brake operating switch) and a motor connection 8. A three-phase asynchronous motor 9 is connected, as lift drive motor, to the frequency converter 1. The emergency current supply equipment is denoted by 10 and comprises on the one hand an energy storage unit 11 consisting of supercapacitors 13 and on the other hand a power flow regulator 12. Branch circuits 17 connect the direct voltage intermediate circuit 5 with the current supply of electrical lift components 18 which have to function for evacuation travels, such as, for example, the lift controller, the mechanical drive brake, the door drive, the lighting, communications devices, the ventilating system, etc.

In normal operation the mains current rectifier 3 of the frequency converter 1 draws alternating current (three-phase current) by way of the mains connection 2 from the current mains and generates therefrom direct current which it feeds into the direct voltage intermediate circuit 5. The alternating current rectifier 4 takes off direct current from this direct voltage intermediate circuit 5 and produces therefrom, controlled by an integrated control generator, a frequency-variable alternating current (three-phase current) as current supply for the three-phase asynchronous motor 9. The produced three-phase current frequency determines the rotational speed of this motor and thus the travel speed of the lift, wherein a central lift controller delivers to the control generator of the alternating current rectifier instantaneous data in suitable form about the travel speed to be generated at a specific instant in time. The smoothing capacitor 6 suppresses ripples and voltage peaks in the direct voltage intermediate circuit 5. The brake module 7 serves for conversion of the brake energy produced by the three-phase asynchronous motor 9 during journeys with negative motor loading into heat insofar as the mains voltage rectifier 3 is not provided and designed for the recuperation of this brake energy into the mains. In the latter case the brake module 7 further has the task of ensuring electrical braking capability of the three-phase asynchronous motor 9 in the case of defective mains current rectifier 3, wherein the brake module 7 is activated as soon as the voltage in the direct voltage intermediate circuit 5 during braking exceeds a defined value. The power flow regulator 12, essentially a commercially available 2-quadrant direct voltage setter for one voltage polarity and two current directions, has the task of controlling the energy flow between the different voltage levels of the direct voltage intermediate circuit 5 and the energy storage unit 11. On the one hand the energy storage unit is charged by way of the power flow regulator 12 during the entire use readiness of the lift installation in the case of energy excess in the direct voltage intermediate circuit 5, and on the other hand this supplies the stored energy as needed, i.e. in the event of temporary drops or interruptions in mains voltage and failure of the mains supply, back into the aforesaid direct voltage intermediate circuit 5.

In the case of temporary drops or interruptions in mains voltage and also in the case of failure of the mains supply during travel of the lift, the direct voltage intermediate circuit 5 and therewith also the alternating current rectifier 4 as well as the components 18, which are supplied by way of the branch circuits 17 and must function for evacuation travels, are thus supplied without interruption with energy at least until the lift car has reached the storey with shaft doors. The supercapacitors 13 of the energy storage unit 11 are thus in the position of delivering without delay the maximum current needed for a full-load travel and are fully recharged again in the shortest time when the mains supply is again operationally ready. This has a particularly advantageous effect in installations where interruptions in the mains supply arise frequently and in short succession. In the case of emergency current supply equipment based on batteries it is necessary, in contrast thereto, to wait out after each evacuation travel the relatively long-lasting recharging time before the lift can automatically go into operation after the mains supply is again present. Otherwise, there is a considerable risk that the lift car in the event of a fresh current failure is blocked between two storeys.

FIG. 2 schematically shows a lift drive with frequency converter 1, as previously described in relation to FIG. 1, as well as with an emergency current supply equipment 10 according to the invention, in which the energy storage unit 11 is composed of two different storage media. In order to cover the energy requirement for bridging over temporary drops or interruptions in mains voltage, as well as for shorter evacuation journey paths, the energy storage unit 11 comprises supercapacitors 13 with the already-described advantageous properties thereof as the storage medium. So that the storage unit 11 can also deliver sufficient energy for evacuation travels with longer travel paths, it comprises batteries 14 (secondary elements) as an additional storage medium, for example lead or Ni—Cd batteries. Such batteries 14 have, by comparison with supercapacitors 13, a substantially higher energy density (in Wh/kg), i.e. a battery can store substantially more energy for the same weight. However, they do not have available, for sizes which are still rational, the same reaction speed for rapid operations with high power requirement, and their service life is drastically reduced by frequently occurring operations of that kind. In the case of the combination of energy storage media according to the invention the frequently occurring, temporarily required power peaks for bridging over temporary drops and interruptions in mains voltage and for short evacuation travels are withdrawn from the supercapacitors 13, and for evacuation travels of longer duration the required energy is obtained from both storage media. Resulting therefrom is an optimum low necessary overall weight of the energy storage unit 11 for an optimum service life. The described energy storage unit 11 co-operates in the same manner, as also explained in the description relative to FIG. 1, by way of a power flow regulator 12 with the direct voltage intermediate circuit of the frequency converter, wherein this power flow regulator 12 is so controlled in the case of the embodiment of the energy storage unit present here that energy is obtained from the batteries only for operations of longer durations. The components 18 which have to function for evacuation travels are now also supplied here with energy from the direct voltage intermediate circuit 5 in uninterrupted manner in every situation by way of the branch circuit 17.

FIG. 3 describes the arrangement of the electrical components of one group of lift drives regulated by frequency converting, wherein several three-phase asynchronous motors 9 are connected by way of associated alternating current rectifiers 4 to a common direction voltage intermediate circuit 16, which is supplied in normal operation from a single power unit 15 and in the case of drops and interruptions in mains voltage as well as in the case of complete failure of the mains supply during the travel of the lift is supplied with energy by a single emergency current supply equipment 10 according to the invention. The emergency current supply equipment 10 here, too consists of an energy storage unit 11 and a power flow regulator 12, wherein the energy storage unit 11 consists either exclusively of supercapacitors or of an afore-described combination of supercapacitors and batteries. The power flow regulator 12 has the same function as was already described. Here, too, the components 18 which must be functionally capable for an evacuation travel are, in the event of failure of the mains supply, fed with energy by way branch circuits 17 from the common direct voltage intermediate circuit 16 without interruption. Such a multiple arrangement of drives has, firstly, the advantage that only a single power unit 15 is required, which preferably has the capability (usually too expensive for an individual drive in the lower performance range) to feed back excess braking energy into the mains. Secondly, direct energy compensation processes between driving and braking drives can take place by way of the common direct voltage intermediate circuit 16, which reduces energy costs. Moreover, instead of several separate emergency current supply equipments only a single emergency current supply equipment 10 according to the invention is required, which has the consequence of a substantial reduction in the outlay on hardware and thus in costs.

What is claimed is:

1. An emergency current supply equipment for a lift installation having an electric motor drive and a lift cage, the equipment comprising an electrical energy storage unit comprising super capacitors for bridging over temporary drops or interruptions in mains voltage for ensuring performance of an evacuation travel in the event of a failure at a mains supply during a lift travel by supplying energy to all electrical components of the lift installation which participate in the evacuation travel until such time as the lift cage has reached a level of a story; a frequency converter for regulating travel speed of the lift, the frequency converter having a direct voltage intermediate circuit; the electrical energy storage unit being coupled to the intermediate circuit such that the electrical energy storage unit is both charged by the intermediate circuit and the electrical energy storage unit supplies stored energy beck to the intermediate circuit as needed; and a power flow regulator is interposed between the intermediate circuit and the energy storage unit for controlling energy flow therebetween.

2. The equipment according to claim 1, characterized in that the energy storage unit comprises a combination of super capacitors and electrochemically acting batteries.

3. The equipment according to claim 1, charactetized in that in the event of failure of the mains supply it supplies at least those electrical components, which must function for a full evacuation travel, of the lift installation with emergency current by way of the direct voltage intermediate circuit of the frequency converter, wherein these components are also supplied in normal operation from the direct voltage intermediate circuit.

4. A method for supplying emergency current in a lift installation having an electric motor drive in which, in the event of a failure of a mains supply or a temporary drop or interruption in mains voltage during a lift travel an emergency current supply equipment supplies the components which are important for evacuation travel of the lift installation with energy at least until such time as a lift cage has reached a level of a story, comprising the steps of storing at least a portion of the emergency current supply energy of the emergency current supply equipment in storage media in the form of supercapacitors; permanently connecting the emergency current supply equipment to a direct voltage intermediate circuit of a frequency converter through a power flow regulator; charging the emergency current supply through the power flow regulator from the direct voltage intermediate circuit during low power requirement operation phases of the drive system; passing energy from the emergency current supply through the power flow regulator to the direct current intermediate circuit to reduce mains supply power required by the lift installation during high power requirement operation phases of the drive system; and recuperating electrical energy and delivering such recouped energy to the emergency current supply during braking processes.

5. The method according to claim 4, characterized in that in the event of failure of the mains supply or temporary drops or interruptions in mains voltage the emergency current supply equipment comes into use free of interruption.

6. The method according to claim 5 or 4, characterized in that a single emergency current supply equipment supplies several lifts.

7. The method according to claim 5 or 4, characterized in that the emergency current supply equipment is installed either to be stationary in the building or to be mobile on a lift vehicle with integrated drives.

* * * * *